US008970188B2

(12) United States Patent
Ganta

(10) Patent No.: US 8,970,188 B2
(45) Date of Patent: Mar. 3, 2015

(54) ADAPTIVE FREQUENCY COMPENSATION FOR HIGH SPEED LINEAR VOLTAGE REGULATOR

(71) Applicant: Synaptics Incorporated, San Jose, CA (US)

(72) Inventor: Saikrishna Ganta, San Jose, CA (US)

(73) Assignee: Synaptics Incorporated, San Jose, CA (US)

( * ) Notice: Subject to any disclaimer, the term of this patent is extended or adjusted under 35 U.S.C. 154(b) by 75 days.

(21) Appl. No.: 13/874,400

(22) Filed: Apr. 30, 2013

(65) Prior Publication Data

US 2014/0300332 A1 Oct. 9, 2014

Related U.S. Application Data

(60) Provisional application No. 61/809,077, filed on Apr. 5, 2013.

(51) Int. Cl.
*G05F 1/56* (2006.01)

(52) U.S. Cl.
CPC ..... *G05F 1/56* (2013.01)
USPC ..... 323/273

(58) Field of Classification Search
USPC ..... 323/265, 273–277
See application file for complete search history.

(56) References Cited

U.S. PATENT DOCUMENTS 5,559,424 A * 9/1996 Wrathall et al. ..... 323/277
5,889,393 A 3/1999 Wrathall
6,522,111 B2 * 2/2003 Zadeh et al. ..... 323/277
6,765,374 B1 * 7/2004 Yang et al. ..... 323/280
6,794,914 B2 * 9/2004 Sani et al. ..... 327/202
6,806,690 B2 10/2004 Xi
7,215,103 B1 5/2007 Wong et al.
7,570,035 B2 * 8/2009 Kleveland ..... 323/276
8,080,983 B2 12/2011 Lourens et al.
8,089,261 B2 * 1/2012 Lipka ..... 323/315
8,289,009 B1 10/2012 Strik et al.
2008/0169795 A1 7/2008 Wang
2013/0147271 A1 * 6/2013 Yotsuji et al. ..... 307/28

OTHER PUBLICATIONS

Den Besten, Gerrit W. et al., "Embedded 5 V-to-3.3 V Voltage Regulator for Supplying Digital IC's in 3.3 V CMOS Technology", IEEE Journal of Solid-State Circuits, vol. 33, No. 7, Jul. 1998, 956-962.

(Continued)

*Primary Examiner* — Adolf Berhane

(57) ABSTRACT

In a linear voltage regulator, a first stage outputs an output signal. The first stage is configured with a first switchable bias current, and is configured to receive a feedback signal. A second stage provides a regulated voltage output. A decoupling capacitor is coupled to the regulated voltage output. A feedback circuit is coupled with the second stage and configured to generate the feedback signal. A frequency compensation circuit includes a second switchable bias current. The frequency compensation circuit: pushes away an existing pole to a higher frequency when the first and second switchable bias currents are operated in a sleep mode; and creates a left-hand-side zero when the first and second switchable bias currents are operated in an active mode. The active mode comprises the first and second switchable bias currents supplying greater currents than are provided in the sleep mode.

19 Claims, 8 Drawing Sheets

(56) References Cited

OTHER PUBLICATIONS

Mishra, Sudhansu Sekhar et al., "Understand linear regulator stability", http://www.edn.com/design/test-and-measurement/4401984/Understand-linear-regulator-stability, Nov. 26, 2012, 1-4.

Rinc&Oacute, Gabriel A. et al., "Power Supply Ripple Rejection and Linear Regulators: What's all the noise about?", http://www.eetimes.com/design/power-management-design/4011587/Power-Supply-Ripple-Rejection-and-Linear-Regulators-What-s-all-the-noise-about-/, Sep. 20, 2005, 1-6.

Roberts, Alan L. et al., "A 256K SRAM with On-Chip Power Supply Conversion", ISSC 87, Session XIX: High Density SRAMs, Feb. 27, 1987, 252-253 & 414.

Unknown, "Low Drop-Out Voltage Regulators", ECEN 607(ESS) Analog and Mixed-Signal Center, Texas A&M University, amesp02.tamu.edu/~sanchez/607%20Lect%2012%20LDO.ppt, Jan. 22, 2008, 1-70.

* cited by examiner

ADAPTIVE FREQUENCY COMPENSATION FOR HIGH SPEED LINEAR VOLTAGE REGULATOR

CROSS REFERENCE TO RELATED U.S. APPLICATION (PROVISIONAL)

This application claims priority to and benefit of U.S. Provisional Patent Application No. 61/809,077 filed on Apr. 5, 2013, entitled "Adaptive Frequency Compensation for High Speed Linear Voltage Regulator" by Saikrishna Ganta, assigned to the assignee of the present application, and which is hereby incorporated by reference in its entirety herein.

BACKGROUND

Linear voltage regulators are used to regulate a voltage provided to a load. Many user input devices require voltage regulation and include linear voltage regulators. Many aspects of a high speed linear voltage regulator may be implemented within an integrated circuit. Some aspects, such as a decoupling capacitor, are sometimes implemented externally from the integrated circuit. An integrated circuit, that includes components of the linear voltage regulator, may be coupled with one or more of its external components, such as an external decoupling capacitor, via a printed circuit board.

Input devices including proximity sensor devices (also commonly called touchpads or touch sensor devices) are widely used in a variety of electronic systems. A proximity sensor device typically includes a sensing region, often demarked by a surface, in which the proximity sensor device determines the presence, location and/or motion of one or more input objects. Proximity sensor devices may be used to provide interfaces for the electronic system. For example, proximity sensor devices are often used as input devices for larger computing systems (such as opaque touchpads integrated in, or peripheral to, notebook or desktop computers). Proximity sensor devices are also often used in smaller computing systems (such as touch screens integrated in cellular phones and tablet computers). Such touch screen input devices are typically superimposed upon or otherwise collocated with a display of the electronic system.

SUMMARY

In a linear voltage regulator, a first stage outputs an output signal. The first stage is configured with a first switchable bias current, and is configured to receive a feedback signal. A second stage provides a regulated voltage output. A decoupling capacitor is coupled to the regulated voltage output. A feedback circuit is coupled with the second stage and configured to generate the feedback signal. A frequency compensation circuit includes a second switchable bias current. The frequency compensation circuit: pushes away an existing pole to a higher frequency when the first and second switchable bias currents are operated in a sleep mode; and creates a left-hand-side zero when the first and second switchable bias currents are operated in an active mode. The active mode comprises the first and second switchable bias currents supplying greater currents than are provided in the sleep mode.

BRIEF DESCRIPTION OF DRAWINGS

The drawings referred to in this Brief Description of Drawings should not be understood as being drawn to scale unless specifically noted. The accompanying drawings, which are incorporated in and form a part of the Description of Embodiments, illustrate various embodiments and, together with the Description of Embodiments, serve to explain principles discussed below, where like designations denote like elements.

DESCRIPTION OF EMBODIMENTS

The following Description of Embodiments is merely provided by way of example and not of limitation. Furthermore, there is no intention to be bound by any expressed or implied theory presented in the preceding Background, Summary, or Brief Description of Drawings or the following Description of Embodiments.

Overview of Discussion

Herein, various embodiments are described that provide high speed linear voltage regulators, input devices, processing systems, and methods that facilitate improved usability. In various embodiments described herein, the input device may be a capacitive input device. Utilizing techniques described herein, efficiencies may be achieved by utilizing a smaller external decoupling capacitor and/or operating at a higher frequency than may be used in conventional embodiments and/or by increasing the stable bandwidth over which a linear voltage regulator operates.

Discussion begins with a description of an example input device with which or upon which various embodiments described herein may be implemented. An example sensor electrode pattern is then described. A block diagram of an example high speed linear voltage regulator is described. A circuit diagram of the block diagram, according to an embodiment, is then described. Example Bode plots are then presented which compare active mode operation of the current technology with active mode operation of conventional technology. Finally, example Bode plots are presented which compare sleep mode operation of the current technology when sleep mode compensation components are used and when active mode compensation components are used.

Example Input Device

Figure 1:
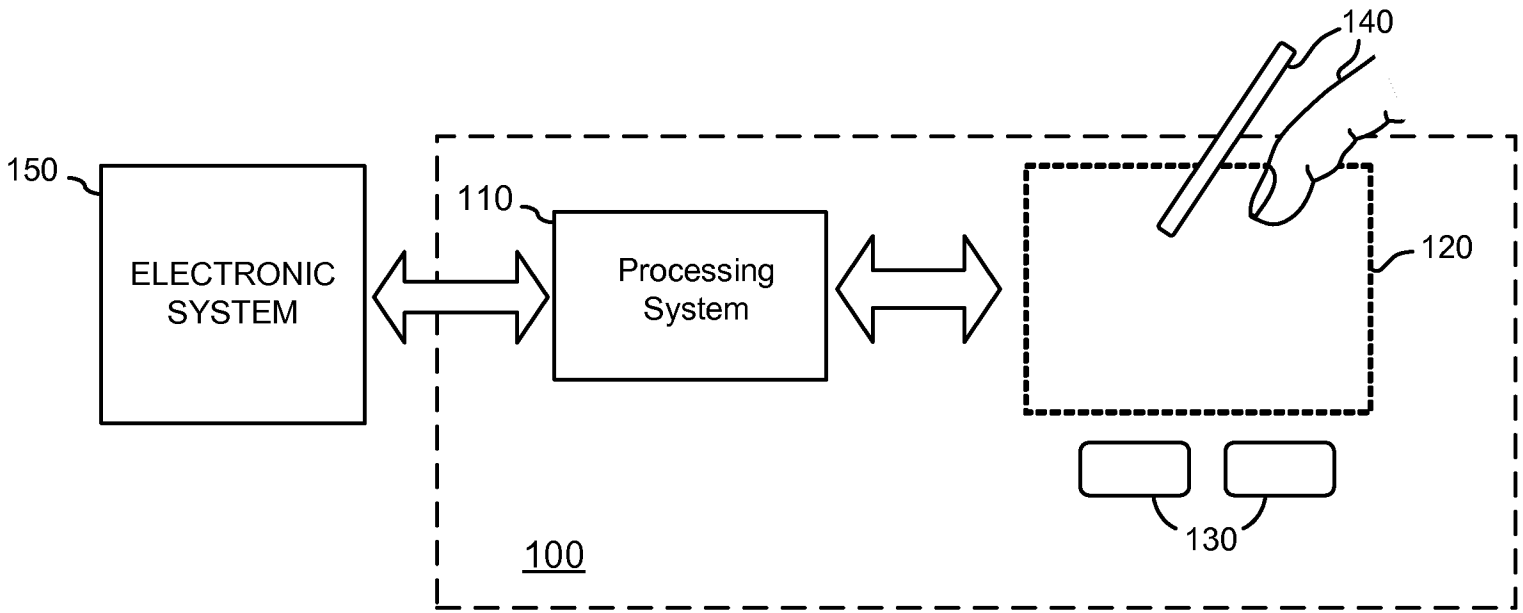
FIG. 1 is a block diagram of an example input device, in accordance with embodiments.

Turning now to the figures, FIG. 1 is a block diagram of an exemplary input device 100, in accordance with various embodiments.

Input device 100 may be configured to provide input to an electronic system/device 150. As used in this document, the term "electronic system" (or "electronic device") broadly refers to any system capable of electronically processing information. Some non-limiting examples of electronic systems include personal computers of all sizes and shapes, such as desktop computers, laptop computers, netbook computers, tablets, web browsers, e-book readers, and personal digital assistants (PDAs). Additional example electronic systems include composite input devices, such as physical keyboards that include input device 100 and separate joysticks or key switches. Further example electronic systems include peripherals such as data input devices (including remote controls and mice), and data output devices (including display screens and printers). Other examples include remote terminals, kiosks, and video game machines (e.g., video game consoles, portable gaming devices, and the like). Other examples include communication devices (including cellular phones, such as smart phones), and media devices (including recorders, editors, and players such as televisions, set-top boxes, music players, digital photo frames, and digital cameras). Additionally, the electronic systems could be a host or a slave to the input device.

Input device 100 can be implemented as a physical part of an electronic system 150, or can be physically separate from electronic system 150. As appropriate, input device 100 may communicate with parts of the electronic system using any one or more of the following: buses, networks, and other wired or wireless interconnections. Examples include, but are not limited to: Inter-Integrated Circuit (I2C), Serial Peripheral Interface (SPI), Personal System 2 (PS/2), Universal Serial Bus (USB), Bluetooth®, Radio Frequency (RF), and Infrared Data Association (IrDA).

In FIG. 1, input device 100 is shown as a proximity sensor device (also often referred to as a "touchpad" or a "touch sensor device") configured to sense input provided by one or more input objects 140 in a sensing region 120. Example input objects include fingers and styli, as shown in FIG. 1.

Sensing region 120 encompasses any space above, around, in and/or near input device 100, in which input device 100 is able to detect user input (e.g., user input provided by one or more input objects 140). The sizes, shapes, and locations of particular sensing regions may vary widely from embodiment to embodiment. In some embodiments, sensing region 120 extends from a surface of input device 100 in one or more directions into space until signal-to-noise ratios prevent sufficiently accurate object detection. The distance to which this sensing region 120 extends in a particular direction, in various embodiments, may be on the order of less than a millimeter, millimeters, centimeters, or more, and may vary significantly with the type of sensing technology used and the accuracy desired. Thus, some embodiments sense input that comprises no contact with any surfaces of input device 100, contact with an input surface (e.g., a touch surface) of input device 100, contact with an input surface of input device 100 coupled with some amount of applied force or pressure, and/or a combination thereof. In various embodiments, input surfaces may be provided by surfaces of casings within which the sensor electrodes reside, by face sheets applied over the sensor electrodes or any casings, etc. In some embodiments, sensing region 120 has a rectangular shape when projected onto an input surface of input device 100.

Input device 100 may utilize any combination of sensor components and sensing technologies to detect user input in sensing region 120. Input device 100 comprises one or more sensing elements for detecting user input. As a non-limiting example, input device 100 may use capacitive techniques.

Some implementations are configured to provide images that span one, two, three, or higher dimensional spaces. Some implementations are configured to provide projections of input along particular axes or planes.

In some capacitive implementations of input device 100, voltage or current is applied to create an electric field. Nearby input objects cause changes in the electric field, and produce detectable changes in capacitive coupling that may be detected as changes in voltage, current, or the like.

Some capacitive implementations utilize arrays or other regular or irregular patterns of capacitive sensing elements to create electric fields. In some capacitive implementations, separate sensing elements may be ohmically shorted together to form larger sensor electrodes. Some capacitive implementations utilize resistive sheets, which may be uniformly resistive.

Some capacitive implementations utilize "self capacitance" (or "absolute capacitance") sensing methods based on changes in the capacitive coupling between sensor electrodes and an input object. In various embodiments, an input object near the sensor electrodes alters the electric field near the sensor electrodes, thus changing the measured capacitive coupling. In one implementation, an absolute capacitance sensing method operates by modulating sensor electrodes with respect to a reference voltage (e.g., system ground), and by detecting the capacitive coupling between the sensor electrodes and input objects.

Some capacitive implementations utilize "mutual capacitance" (or "transcapacitance") sensing methods based on changes in the capacitive coupling between sensor electrodes. In various embodiments, an input object near the sensor electrodes alters the electric field between the sensor electrodes, thus changing the measured capacitive coupling. In one implementation, a transcapacitive sensing method operates by detecting the capacitive coupling between one or more transmitter sensor electrodes (also "transmitter electrodes" or "transmitters") and one or more receiver sensor electrodes (also "receiver electrodes" or "receivers"). Collectively transmitters and receivers may be referred to as sensor electrodes or sensor elements. Transmitter sensor electrodes may be modulated relative to a reference voltage (e.g., system ground) to transmit transmitter signals. Receiver sensor electrodes may be held substantially constant relative to the reference voltage to facilitate receipt of resulting signals. A resulting signal may comprise effect(s) corresponding to one or more transmitter signals, and/or to one or more sources of environmental interference (e.g., other electromagnetic signals). Sensor electrodes may be dedicated transmitters or receivers, or may be configured to both transmit and receive. In some embodiments, one or more receiver electrodes may be operated to receive a resulting signal when no transmitter electrodes are transmitting (e.g., the transmitters are disabled). In this manner, the resulting signal represents noise detected in the operating environment of sensing region 120.

In FIG. 1, a processing system 110 is shown as part of input device 100. Processing system 110 is configured to operate the hardware of input device 100 to detect input in sensing region 120. Processing system 110 comprises parts of or all of one or more integrated circuits (ICs) and/or other circuitry components. (For example, a processing system for a mutual capacitance sensor device may comprise transmitter circuitry configured to transmit signals with transmitter sensor electrodes, and/or receiver circuitry configured to receive signals with receiver sensor electrodes). In some embodiments, processing system 110 also comprises electronically-readable instructions, such as firmware code, software code, and/or the like. In some embodiments, components composing processing system 110 are located together, such as near sensing element(s) of input device 100. In other embodiments, components of processing system 110 are physically separate with one or more components close to sensing element(s) of input device 100, and one or more components elsewhere. For example, input device 100 may be a peripheral coupled to a desktop computer, and processing system 110 may comprise software configured to run on a central processing unit of the desktop computer and one or more ICs (perhaps with associated firmware) separate from the central processing unit. As another example, input device 100 may be physically integrated in a phone, and processing system 110 may comprise circuits and firmware that are part of a main processor of the phone. In some embodiments, processing system 110 is dedicated to implementing input device 100. In other embodiments, processing system 110 also performs other functions, such as operating display screens, driving haptic actuators, etc.

Processing system 110 may be implemented as a set of modules that handle different functions of processing system 110. Each module may comprise circuitry that is a part of processing system 110, firmware, software, or a combination thereof. In various embodiments, different combinations of modules may be used. Example modules include hardware operation modules for operating hardware such as sensor electrodes and display screens, data processing modules for processing data such as sensor signals and positional information, and reporting modules for reporting information. Further example modules include sensor operation modules configured to operate sensing element(s) to detect input, identification modules configured to identify gestures such as mode changing gestures, and mode changing modules for changing operation modes.

In some embodiments, processing system 110 responds to user input (or lack of user input) in sensing region 120 directly by causing one or more actions. Example actions include changing operation modes, as well as GUI actions such as cursor movement, selection, menu navigation, and other functions. In some embodiments, processing system 110 provides information about the input (or lack of input) to some part of the electronic system (e.g., to a central processing system of the electronic system that is separate from processing system 110, if such a separate central processing system exists). In some embodiments, some part of the electronic system processes information received from processing system 110 to act on user input, such as to facilitate a full range of actions, including mode changing actions and GUI actions.

For example, in some embodiments, processing system 110 operates the sensing element(s) of input device 100 to produce electrical signals indicative of input (or lack of input) in sensing region 120. Processing system 110 may perform any appropriate amount of processing on the electrical signals in producing the information provided to the electronic system. For example, processing system 110 may digitize analog electrical signals obtained from the sensor electrodes. As another example, processing system 110 may perform filtering or other signal conditioning. As yet another example, processing system 110 may subtract or otherwise account for a baseline, such that the information reflects a difference between the electrical signals and the baseline. As yet further examples, processing system 110 may determine positional information, recognize inputs as commands, recognize handwriting, and the like.

"Positional information" as used herein broadly encompasses absolute position, relative position, velocity, acceleration, and other types of spatial information. Exemplary "zero-dimensional" positional information includes near/far or contact/no contact information. Exemplary "one-dimensional" positional information includes positions along an axis. Exemplary "two-dimensional" positional information includes motions in a plane. Exemplary "three-dimensional" positional information includes instantaneous or average velocities in space. Further examples include other representations of spatial information. Historical data regarding one or more types of positional information may also be determined and/or stored, including, for example, historical data that tracks position, motion, or instantaneous velocity over time.

In some embodiments, input device 100 is implemented with additional input components that are operated by processing system 110 or by some other processing system. These additional input components may provide redundant functionality for input in sensing region 120, or some other functionality. FIG. 1 shows buttons 130 near sensing region 120 that can be used to facilitate selection of items using input device 100. Other types of additional input components include sliders, balls, wheels, switches, and the like. Conversely, in some embodiments, input device 100 may be implemented with no other input components.

In some embodiments, input device 100 may be a touch screen, and sensing region 120 overlaps at least part of an active area of a display screen. For example, input device 100 may comprise substantially transparent sensor electrodes overlaying the display screen and provide a touch screen interface for the associated electronic system 150. The display screen may be any type of dynamic display capable of displaying a visual interface to a user, and may include any type of light emitting diode (LED), organic LED (OLED), cathode ray tube (CRT), liquid crystal display (LCD), plasma, electroluminescence (EL), or other display technology. Input device 100 and the display screen may share physical elements. For example, some embodiments may utilize some of the same electrical components for displaying and sensing. As another example, the display screen may be operated in part or in total by processing system 110.

It should be understood that while many embodiments are described in the context of a fully functioning apparatus, the mechanisms are capable of being distributed as a program product (e.g., software) in a variety of forms. For example, the mechanisms that are described may be implemented and distributed as a software program on information bearing media that are readable by electronic processors (e.g., non-transitory computer-readable and/or recordable/writable information bearing media readable by processing system 110). Additionally, the embodiments apply equally regardless of the particular type of medium used to carry out the distribution. Examples of non-transitory, electronically readable media include various discs, memory sticks, memory cards, memory modules, and the like. Electronically readable media may be based on flash, optical, magnetic, holographic, or any other tangible storage technology.

Sensor Electrode Pattern

Figure 2:
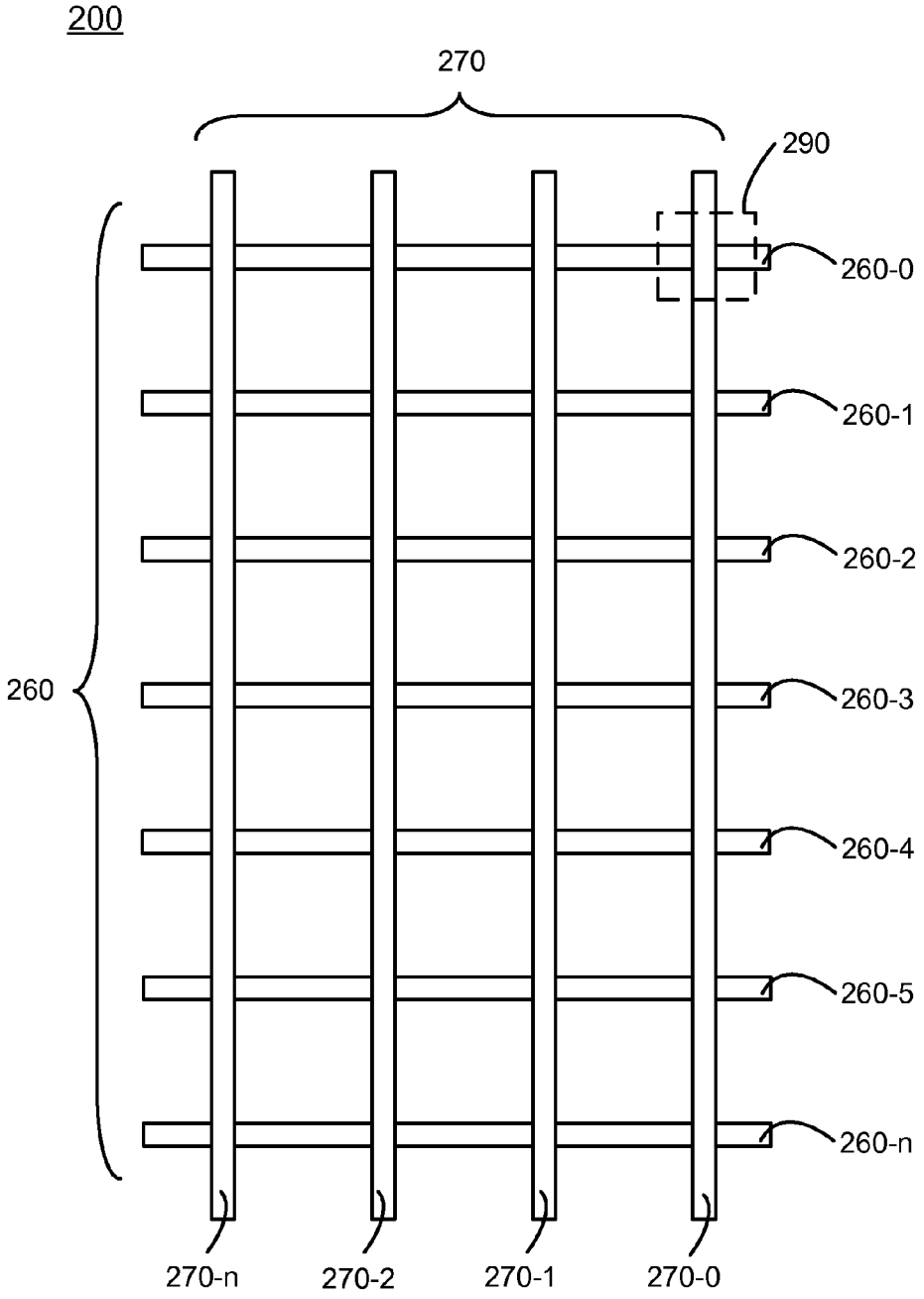
FIG. 2 shows a portion of an example sensor electrode pattern which may be utilized in a sensor to generate all or part of the sensing region of an input device, such as a touch screen, according to some embodiments.

FIG. 2 shows a portion of an example sensor electrode pattern 200 which may be utilized in a sensor to generate all or part of the sensing region of an input device 100, according to various embodiments.

Input device 100 is configured as a capacitive input device when utilized with a capacitive sensor electrode pattern. For purposes of clarity of illustration and description, a non-limiting simple rectangular sensor electrode pattern 200 is illustrated. It is appreciated that numerous other sensor electrode patterns may be employed including patterns with a single set of sensor electrodes, patterns with two sets of sensor electrodes disposed in a single layer (without overlapping), and patterns that provide individual button electrodes. The illustrated sensor electrode pattern is made up of a plurality of receiver electrodes 270 (270-0, 270-1, 270-2 . . . **270-*n*) and a plurality of transmitter electrodes 260 (260-0, 260-1, 260-2 . . . 260-*n*) which overlay one another, in this example. In the illustrated example, touch sensing pixels are centered at locations where transmitter and receiver electrodes cross. Capacitive pixel 290 illustrates one of the capacitive pixels generated by sensor electrode pattern 200 during transcapacitive sensing. It is appreciated that in a crossing sensor electrode pattern, such as the illustrated example, some form of insulating material or substrate is typically disposed between transmitter electrodes 260 and receiver electrodes 270. However, in some embodiments, transmitter electrodes 260 and receiver electrodes 270 may be disposed on the same layer as one another through use of routing techniques and/or jumpers. In various embodiments, touch sensing includes sensing input objects anywhere in sensing region 120 and may comprise: no contact with any surfaces of the input device 100, contact with an input surface (e.g., a touch surface) of the input device 100, contact with an input surface of the input device 100** coupled with some amount of applied force or pressure, and/or a combination thereof.

When accomplishing transcapacitive measurements, capacitive pixels, such as capacitive pixel 290, are areas of localized capacitive coupling between transmitter electrodes 260 and receiver electrodes 270. The capacitive coupling between transmitter electrodes 260 and receiver electrodes 270 changes with the proximity and motion of input objects in the sensing region associated with transmitter electrodes 260 and receiver electrodes 270.

In some embodiments, sensor electrode pattern 200 is "scanned" to determine these capacitive couplings. That is, the transmitter electrodes 260 are driven to transmit transmitter signals. Transmitters may be operated such that one transmitter electrode transmits at one time, or multiple transmitter electrodes transmit at the same time. Where multiple transmitter electrodes transmit simultaneously, these multiple transmitter electrodes may transmit the same transmitter signal and produce an effectively larger transmitter electrode, or these multiple transmitter electrodes may transmit different transmitter signals. For example, multiple transmitter electrodes may transmit different transmitter signals according to one or more coding schemes that enable their combined effects on the resulting signals of receiver electrodes 270 to be independently determined.

The receiver electrodes 270 may be operated singly or multiply to acquire resulting signals. The resulting signals may be used to determine measurements of the capacitive couplings at the capacitive pixels.

A set of measurements from the capacitive pixels form a "capacitive image" (also "capacitive frame") representative of the capacitive couplings at the pixels. Multiple capacitive images may be acquired over multiple time periods, and differences between them used to derive information about input in the sensing region. For example, successive capacitive images acquired over successive periods of time can be used to track the motion(s) of one or more input objects entering, exiting, and within the sensing region.

In some embodiments, one or more sensor electrodes 260 or 270 may be operated to perform absolute capacitive sensing at a particular instance of time. For example, receiver electrode 270-0 may be charged and then the capacitance of receiver electrode 270-0 may be measured. In such an embodiment, an input object 140 interacting with receiver electrode 270-0 alters the electric field near receiver electrode 270-0, thus changing the measured capacitive coupling. In this same manner, a plurality of sensor electrodes 270 may be used to measure absolute capacitance and/or a plurality of sensor electrodes 260 may be used to measure absolute capacitance. It should be appreciated that when performing absolute capacitance measurements the labels of "receiver electrode" and "transmitter electrode" lose the significance that they have in transcapacitive measurement techniques, and instead a sensor electrode 260 or 270 may simply be referred to as a "sensor electrode."

Example High Speed Linear Voltage Regulator

Figure 3:
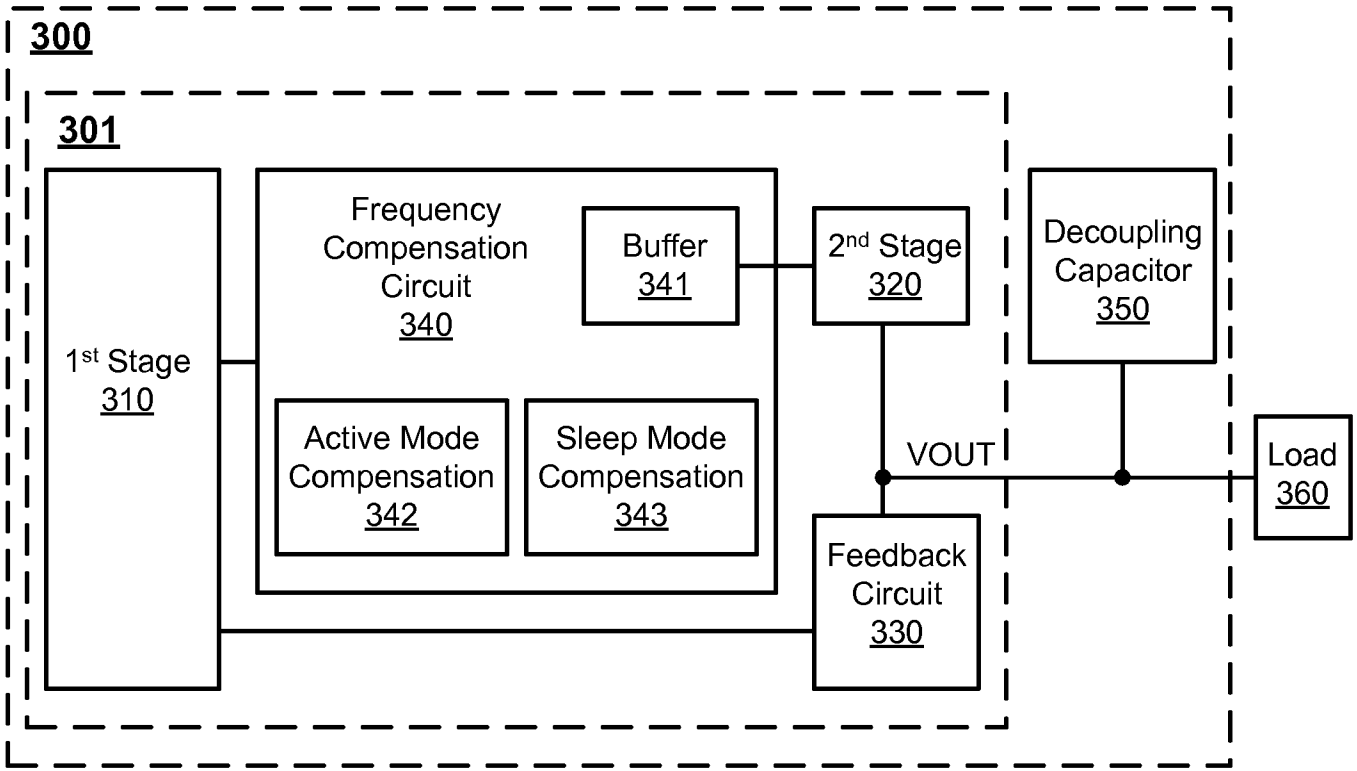
FIG. 3 shows a block diagram of a high speed linear voltage regulator, according to various embodiments.

FIG. 3 shows a block diagram of a high speed linear voltage regulator 300, according to an embodiment. High speed linear voltage regulator 300 employs adaptive frequency compensation by switching in and out certain components to provide frequency compensation for different operating modes of high speed linear voltage regulator 300. As depicted, high speed linear voltage regulator 300 comprises a first stage 310, a second stage 320, a feedback circuit 330, a frequency compensation circuit 340, and a decoupling capacitor 350. Portion 301 of linear voltage regulator 300 is implemented, in one embodiment, as an integrated circuit. According to various embodiments, decoupling capacitor 350 can be either internal or external to integrated circuit portion 301. That is, an external decoupling capacitor 350 and an integrated circuit portion 301 may be coupled with one another via mutual coupling through a printed circuit board. As depicted, a load 360 may be coupled with a regulated output voltage, VOUT, that is output from second stage 320.

First stage 310 comprises an amplifier which has an output that is coupled as an input to frequency compensation circuit 340. Frequency compensation circuit 340 includes a buffer 341, an active mode (high power) compensation portion 342, and a sleep mode (low power) compensation portion 343. A buffered output from buffer 341 is coupled as an input to second stage 320. A decoupling capacitor 350 is coupled with the output of second stage 320. According to some embodiments, the decoupling capacitor may be external to an integrated circuit 301 which includes many or all of the other components of high speed linear voltage regulator 300. A regulated output voltage, VOUT, is provided as an output of second stage 320. This regulated output voltage is used as an input to feedback circuit 330, which provides a feedback signal to first stage 310.

Figure 4A:
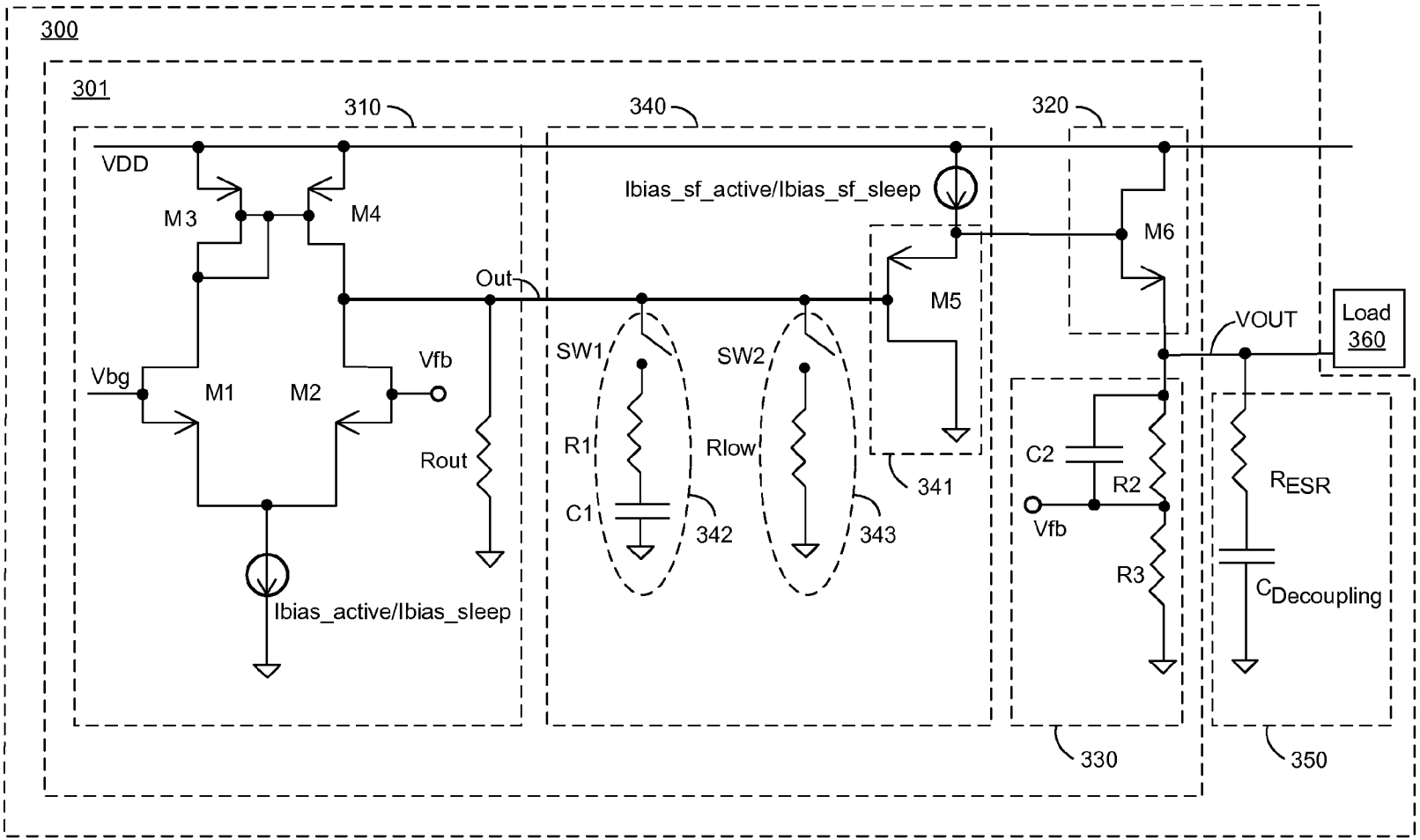
FIG. 4A shows an example circuit diagram of the high speed linear voltage regulator of FIG. 3, according to an embodiment.

FIG. 4A shows an example circuit diagram of the high speed linear voltage regulator 300 of FIG. 3, according to an embodiment. The circuit illustrated in FIG. 4A is one particular implementation of the integrated circuit portion, 301, of the block diagram illustrated in FIG. 3 and shows an embodiment where the decoupling capacitor, $C_{Decoupling}$, located external to portion 301.

In FIG. 4A, high speed linear voltage regulator 300 includes a first stage 310 in the form of a differential amplifier with a first switchable bias current source, Ibias_active/Ibias_sleep; a second stage 320 which provides a regulated voltage output, VOUT, at its output; a feedback circuit 330; and a frequency compensation circuit 340 which includes a second switchable bias current source, Ibias_sf_active/Ibias_sf_sleep. High speed linear voltage regulator 300 is illustrated as being connected with a load 360 that is coupled with the regulated voltage output, VOUT, of second stage 320. A decoupling capacitor 350 is coupled to VOUT of second stage 320. Decoupling capacitor 350 is depicted by an equivalent series resistor, $R_{ESR}$, coupled on a first side with VOUT. $R_{ESR}$ is coupled on a second side with a first side of capacitor $C_{Decoupling}$. The second side of capacitor $C_{Decoupling}$ is coupled with ground. It should be appreciated that $R_{ESR}$ is, in one embodiment, a parasitic capacitance of or associated with $C_{Decoupling}$. In one embodiment, decoupling capacitor 350 is external to integrated circuit portion 301, while in another embodiment, decoupling capacitor 350 may be included as a part of integrated circuit portion 301.

First stage 310 comprises transistors M1, M2, M3, and M4 and a two mode switchable bias current source. M1 and M2 are illustrated as n-channel metal oxide semiconductor field effect transistors (N-channel MOSFET or NMOS). M3 and M4 are illustrated as p-channel metal oxide semiconductor field effect transistors (P-channel MOSFET or PMOS). A supply voltage, VDD, is coupled with the sources of M3 and M4, the gates of M3 and M4 are coupled and the gate and drain of M3 are coupled. The drains of M1 and M3 are coupled, and the drains of M2 and M4 are coupled. The sources of M1 and M2 are coupled with the two mode switchable bias current source, Ibias_active/Ibias_sleep, which supplies a higher bias current (Ibias_active) when high speed linear voltage regulator 300 is operated in active mode and a lower bias current (Ibias_sleep) when high speed linear voltage regulator 300 is operated in sleep mode. A first input to the differential amplifier is a reference voltage provided by a bandgap voltage, Vbg, on the gate of M1. A second input to the differential amplifier is provided by a feedback voltage, Vfb, on the gate of M2. The drains of M2 and M4 are coupled with one another and the output of first stage 310 is taken from a node located between the drains of M2 and M4. Rout represents the low frequency output impedance of the differential amplifier of first stage 310. Rout increases greatly in the sleep mode of operation of high speed linear voltage regulator 300 due to the lower bias current provided by Ibias_sleep when in the sleep mode.

Second stage 320 is an output stage and includes an n-channel MOSFET transistor, M6. M6 has its drain coupled with VDD. Switchable bias current source Ibias_sf_active/Ibias_sf_sleep is coupled between VDD on one side and the gate of M6 and source of M5 on the other side. The source of M6 is where the regulated output voltage, VOUT, is taken and where a load may be coupled. The source of M6 is also the input to feedback circuit 330.

Feedback circuit 330 comprises a voltage divider formed of series resistors R2 and R3. A first side of R2 is coupled with the source of M6 and with a first side of capacitor C2. The second side of resistor R2 is coupled with the first side of resistor R3 and the second side of capacitor C2. The second side of resistor R3 is coupled with ground. A feedback voltage, Vfb, is taken from between resistors R2 and R3 and supplied as the feedback voltage, Vfb, on the gate of M2.

With respect to the overall operation of high speed linear voltage regulator 300, it should be noted that Ibias_active and Ibias_sf_active are provided during an active mode of operation of high speed linear voltage regulator 300, while Ibias_sleep and Ibias_sf_sleep are provided during a sleep mode of operation of high speed linear voltage regulator 300. The active and sleep modes may implemented by a processing system, such as processing system 110, in response to various factors and/or inputs.

Frequency compensation circuit 340 comprises a buffer 341 (PMOS transistor M5); a switchable bias current source, Ibias_sf_active/Ibias_sf_sleep; an active mode compensation portion 342 (SW1, R1, and C1), and a sleep mode compensation portion 343 (SW2 and Rlow). Ibias_sf_active/Ibias_sf_sleep, supplies a bias current to M5 which is a higher bias current (Ibias_sf_active) when in active mode and a lower bias current (Ibias_sf_sleep) while in sleep mode. The nomenclature "sf" stands for "source follower." M5 is a source follower transistor has its source coupled to the gate of M6 and its drain coupled with ground. The gate of M5 is coupled with the output (OUT) of first stage 310 (between the drains of M4 and M2), to a first side of switch SW1, and a first side of switch SW2. M5 acts as a buffer between first stage 310 and second stage 320. Buffer transistor M5, helps in pushing the pole at gate of pass transistor M6 to higher frequencies in both modes of operation, i.e., in both sleep mode and active mode. M5 consumes very low amounts of power when operating in sleep mode. The second side of SW1 is coupled a first side of resistor R1, the second side of resistor R1 is coupled in series to the first side of capacitor C1, and the second side of C1 is coupled to ground. The second side of SW2 is coupled a first side of resistor Rlow, and the second side of Rlow is coupled to ground. When high speed linear voltage regulator 300 is operated in an active mode, switch SW1 is closed and switch SW2 is open, thus causing series R1 and C1 to be used for frequency compensation. When high speed linear voltage regulator 300 is operated in a sleep mode, switch SW2 is closed and switch SW1 is open, thus causing Rlow to be used for frequency compensation. Selection and operation of switches SW1 and SW2 are operated, in one embodiment, by processing system 110. SW1 is closed and SW2 is opened when Ibias_active and Ibias_sf_active are provided during an active mode of operation. SW2 is closed and SW1 is opened when Ibias_sleep and Ibias_sf_sleep are provided during a sleep mode of operation.

Using the circuit illustrated in FIG. 4A, at least a ten times reduction in the size of the external decoupling capacitor (versus conventional linear voltage regulators) may be achieved. For example, if a conventional embodiment required a 2.2 μF decoupling capacitor 350, the circuits of FIG. 3 and FIG. 4A could use a decoupling capacitor 350 that is at least ten times smaller (e.g., 220 nF or smaller) in capacitance value and, in some embodiments, at least 20 times smaller (e.g., 110 nF or smaller) in capacitance value. A smaller external decoupling capacitor is a less expensive component than one of larger capacitance value, which reduces the cost of the bill of materials versus a conventional implementation. A smaller capacitance external decoupling capacitor is also physically smaller than a larger capacitor used in a conventional embodiment, thus taking less space on a printed circuit board and thus allowing room for other components to be added or the size of the printed circuit board to be reduced so that the overall size of a device (e.g., an input device 100) may have a smaller size or form factor.

To achieve a ten times or greater reduction in the capacitance value of external decoupling capacitor 350 (versus the capacitance value used in a conventional embodiment) the speed at which the external decoupling capacitor is recharged must be ten times or greater than that of a conventional embodiment. This bandwidth requirement poses stability issues which are addressed by adding multiple left-hand-side zeros and a buffer stage which helps in pushing out the non-dominant pole (see Bode plots in FIGS. 5 and 6). In active mode, a conventional technique is to use a very large decoupling capacitor which reduces bandwidth of a linear voltage regulator so that the parasitic poles are far away from unity gain bandwidth thereby guaranteeing its stability. This is shown in Bode plot 510 of FIG. 5, which illustrates a Bode plot of a conventional linear voltage regulator. In the embodiments described herein, a smaller value of decoupling capacitor is utilized instead (e.g., a tenfold size reduction or more in some embodiments versus conventional embodiments). Hence, in embodiments described herein bandwidth is actually extended. With this larger bandwidth, versus conventional embodiments, some of the parasitic poles of the amplifier fall within the unity gain bandwidth. In order to maintain stability switch SW1 is closed, which creates a left hand side zero (zero 525 of bode plot 520). Another zero is also obtained in embodiment within the unity gain bandwidth due to the feedforward path created by C2. In the sleep mode, supplied bias currents are lower than in the active mode of operation of high speed linear voltage regulator 300 in order to save power. This can cause the output impedance of the first stage (Rout) to increase substantially, causing a low frequency non-dominant pole at the output of first stage and thus leading to an instability of the high speed linear voltage regulator 300 in sleep mode. To stabilize the high speed linear voltage regulator in sleep mode a low impedance, Rlow, is switched in at the output of first stage 310, and this pushes away the non-dominant pole. For example, see Bode plot 620 of FIG. 6 which shows second pole (pole 612 in Bode plot 610) being pushed rightward and outside of the unity gain and thus no longer appearing in the Bode plot. At the same time that the low impedance is switched in, a series resistor and capacitor (R1 and C1) that are coupled to the output of first stage 310 in the high power, active mode, (to create an in-band left-hand-side zero) are switched out to prevent the combination of C1 and Rlow from forming a left-hand-side pole within the unity gain frequency of the linear regulator.

Figure 4B:
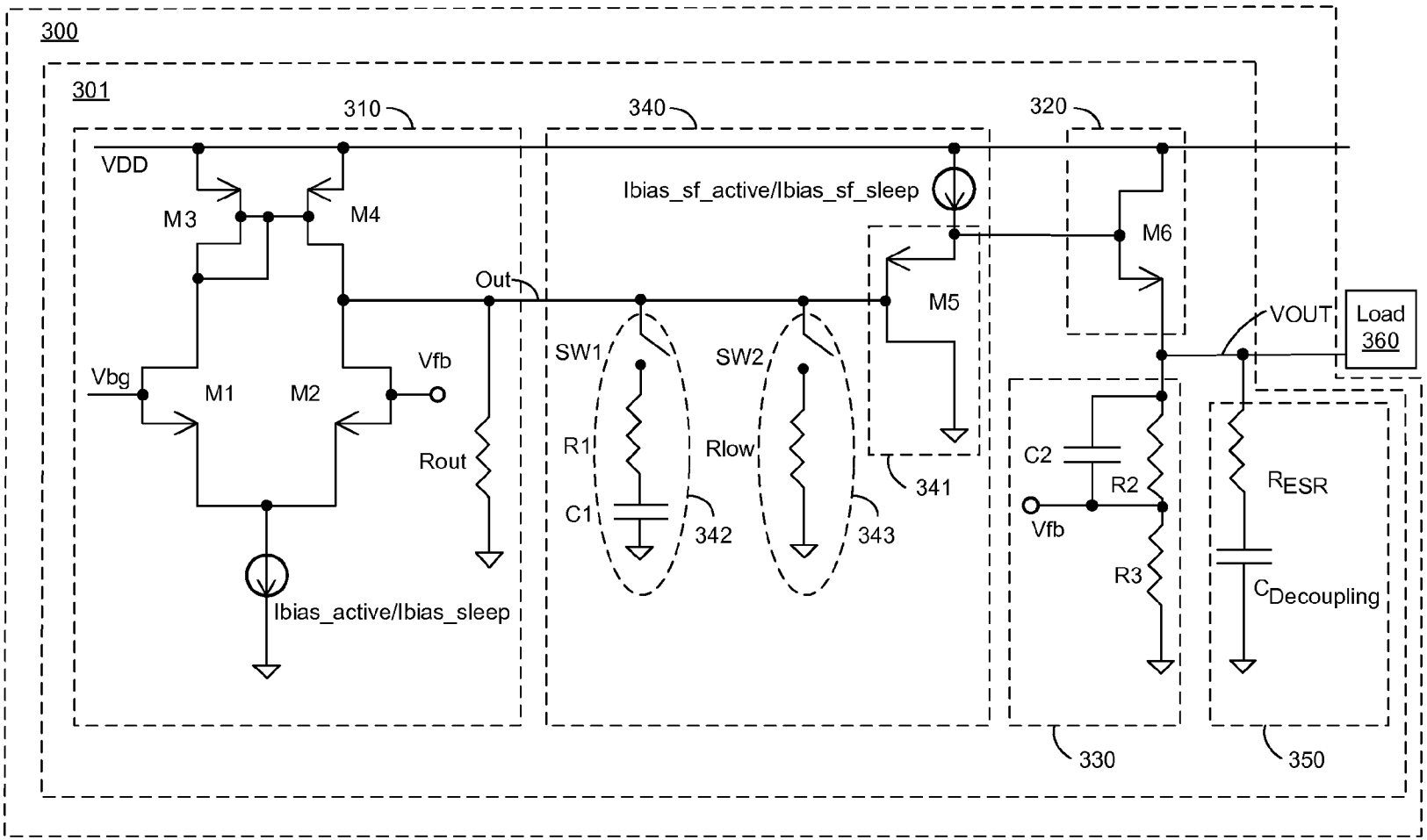
FIG. 4B shows an example circuit diagram of the high speed linear voltage regulator of FIG. 3, according to an embodiment.

FIG. 4B shows an example circuit diagram of the high speed linear voltage regulator of FIG. 3, according to an embodiment. FIG. 4B is identical to FIG. 4A in all respects except that decoupling capacitor 350 is illustrated as being disposed as part of integrated circuit portion 301.

Example Bode Plots

Figure 5:
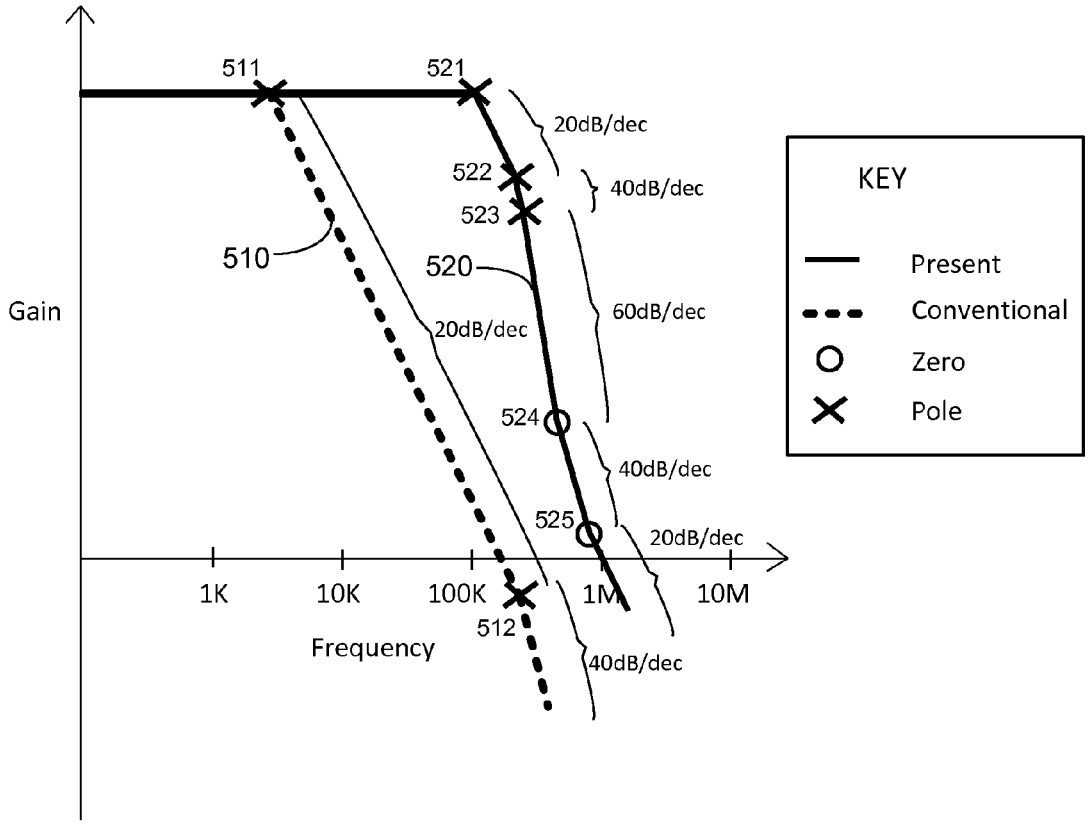
FIG. 5 illustrates a comparison of two active mode Bode plots: an active mode Bode plot of a conventional embodiment compared with an active mode Bode plot of an embodiment of the current technology operating with active mode components employed.

FIG. 5 illustrates a comparison of two active mode Bode plots: an active mode Bode plot 510 of a conventional embodiment compared with an active mode Bode plot 520 of an embodiment of the current technology operating with active mode components employed. It should be noted that in a conventional embodiment a much larger decoupling capacitor (e.g., ten times larger or more) is required for having similar stability and transient performance as the illustrated embodiment of the current technology. Such use of a larger decoupling capacitor is expensive in terms of cost and area of a circuit.

Bode plots 510 and 520 are representative of an operating time period when respective voltage regulators associated with Bode plots 510 and 520 are operating in an active or high power mode, rather than in a sleep mode. For example, with respect to Bode plot 520, of high speed linear voltage regulator 300 is operating with first switchable bias current source Ibias_active/Ibias_sleep in the Ibias_active setting and second switchable bias current source Ibias_sf_active/Ibias_sf_sleep in the Ibias_sf_active setting. In Bode plot 520 switch SW1 is closed and to allow an electrical coupling of active mode compensation portion 342 with output, Out, of first stage 310 while switch SW2 is open so sleep mode compensation portion is not electrically coupled with the output, Out, of first stage 310. Bode plot 510 is representative of a typical response of a conventional linear voltage regulator operating in a high power mode.

Bode plot 510 has a first pole 511 and a second pole 512. Bode plots 510 and 520 overlap until occurrence of first pole 511 of Bode plot 510. Bode plot 520 has a first pole 521, a second pole 522, and a third pole 523, a first zero 524, and a second zero 525.

As can be seen, switching in R1 and C1, when operating in an active mode, creates a left-hand-side zero (the right most zero, 525, in Bode plot 520) which prevents roll off at unity gain from being greater than 20 dB/decade. Unity gain of Bode plot 520 is the point at which Bode plot 520 crosses the x-axis in FIG. 5. Roll of slows from 60 dB/decade after zero 524 and from 40 db/decade to 20 db/decade after zero 525.

Figure 6:
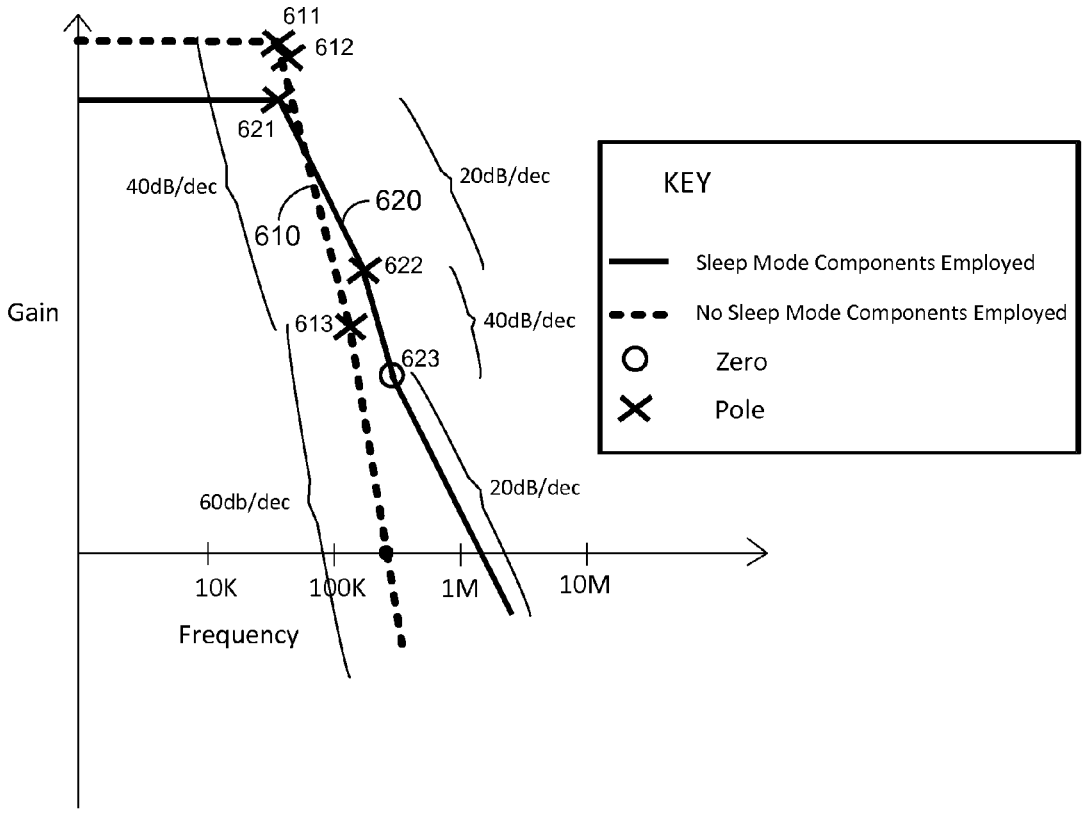
FIG. 6 illustrates a comparison of two sleep mode Bode plots: a sleep mode Bode plot of the current technology operating with active mode compensation circuitry employed and a sleep mode Bode plot of the current technology operating with sleep mode compensation components employed.

FIG. 6 illustrates a comparison of two sleep mode Bode plots: a sleep mode Bode plot 610 of the current technology operating with active mode compensation components employed and a sleep mode Bode plot 620 of the current technology operating with sleep mode compensation components employed. Bode plots 610 and 620 are representative of an operating time period of high speed linear voltage regulator 300 when first switchable bias current source Ibias_active/Ibias_sleep is operating in the Ibias_sleep setting, and when second switchable bias current source Ibias_sf_active/Ibias_sf_sleep is operating in the Ibias_sf_sleep setting. In Bode plot 610 switch SW1 is closed to create an electrical coupling of active mode compensation portion 342 with output, Out, of first stage 310. In Bode plot 620 sleep mode compensation portion 343 has been switching into electrical connectivity with the output, Out, of first stage 310 by closing switch SW2 and switch SW1 has been opened to eliminate an electrical coupling of active mode compensation portion 342 with output, Out, of first stage 310.

Bode plot 610 has a first pole 611, a second pole 612, and a third pole 613. Bode plot 620 has a first pole 621, a second pole 622, a zero 623.

In FIG. 6, it can be seen that switching in Rlow and switching out R1 and C1 shifts or pushes out the previous second pole (612 in bode plot 610), so that it is at least decade away from the unity gain bandwidth when the first and second switchable bias currents are operated in a sleep mode, as shown in bode plot 620. The unity gain bandwidth is the bandwidth at which Bode plot 620 crosses the x-axis. Roll off is also slowed from 40 dB/decade to 20 dB/decade after zero 623. It is well known that the Bode plot response illustrated in plot 610 would cause the linear voltage regulator to be unstable, whereas the Bode plot response illustrated in 620 is stable.

Figure 7:
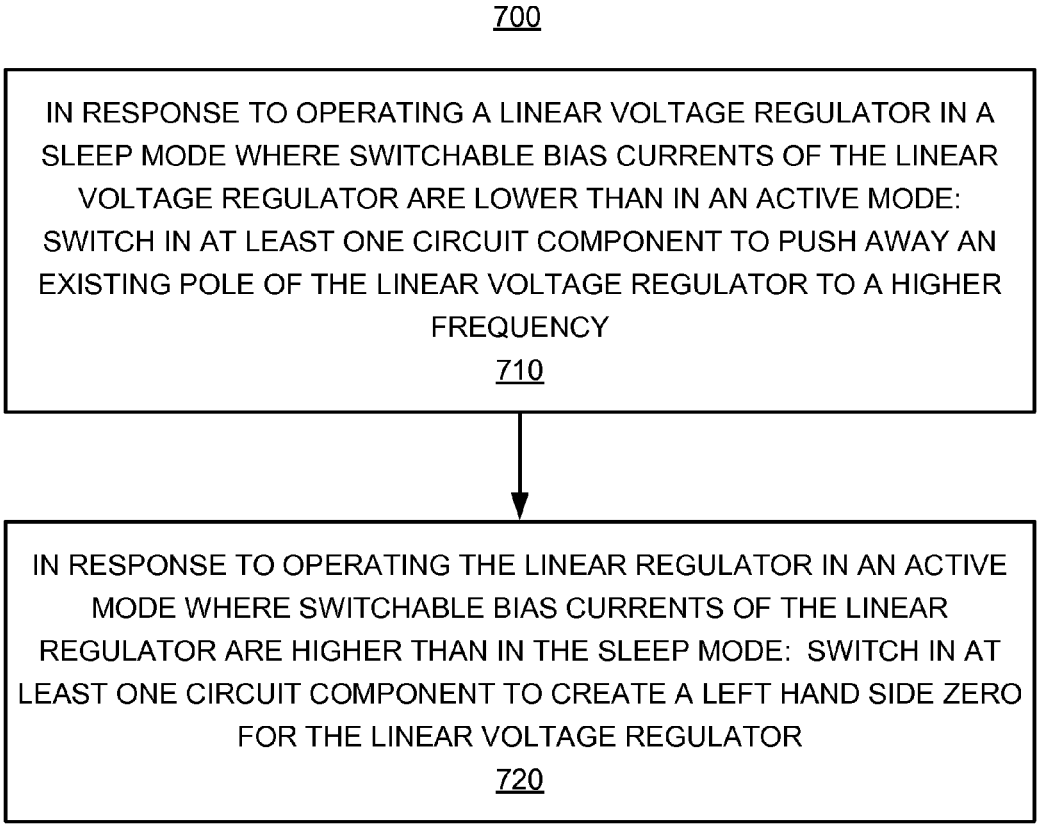
FIG. 7 is a flow diagram of an example method of linear voltage regulation, according to various embodiments.

FIG. 7 is a flow diagram 700 of an example method of linear voltage regulation, according to various embodiments. In discussion of flow diagram 700, reference will be made to components of FIGS. 4A and 4B and features illustrated in FIGS. 5 and 6.

At 710 of flow diagram 700 at least one circuit component is switched in to push away an existing pole of a linear voltage regulator to a higher frequency. The at least one component is switched into use in the linear voltage regulator in response to the linear voltage regulator being operated in a sleep mode where switchable bias currents of the linear voltage regulator are lower than in an active mode of operation of the linear voltage regulator.

For example, with reference to FIGS. 4A and 4B and to high speed linear voltage regulator 300, in an embodiment where first switchable bias current source Ibias_active/Ibias_sleep is in operating in the Ibias_sleep setting and second switchable bias current source Ibias_sf_active/Ibias_sf_sleep in the Ibias_sf_sleep setting, this comprises closing switch SW1 so that R1 is electrically coupled with the output, Out, of first stage 310. In this manner, when switch SW2 is closed: a first side of Rlow is coupled with the output, Out, of first stage 310; and the second side of Rlow is coupled with ground. At the same time, switch SW1 is opened or remains open so that R1 and C1 are not electrically coupled with the output, Out, of first stage 310. By switching in Rlow an existing pole is pushed to a higher frequency that is at least a decade away from a unity gain bandwidth frequency of the linear voltage regulator. Without switching in Rlow the existing pole would be within a decade of said unity gain bandwidth frequency. Pole 612 in Bode plot 610 is caused mainly by Rout and C1. Rout in sleep mode is substantially large, causing the pole 612 to be low frequency. This is undesirable in two ways: first, it creates an additional pole within unity gain bandwidth; second, due to increased gain roll off the effect of the zero caused by R2 and C2 is masked off, because zero caused by R2 and C2 occurs at least a decade away from the unity gain frequency of Bode plot 610. To circumvent this issue, Rlow is switched in during sleep mode by closing SW2. Rlow, being a low impedance, now pushes away pole 612 which occurs at the output of the first stage. To further push away pole 612, switch SW1 is opened to prevent Rlow and C1 forming a pole which is within unity gain frequency. Hence, the new Bode plot (employing sleep mode components) is shown in Bode plot 620. The previously illustrated pole 612 (in Bode plot 610) has been pushed so far out that it is no longer visible in Bode plot 620.

In one embodiment, operation of switch SW1 and switch SW2 is under the control of processing system 110 (see e.g., FIG. 1) or other processing system or control logic coupled with high speed linear voltage regulator 300.

At 720 of flow diagram 700 at least one circuit component is switched in to create a left-hand-side zero for said linear voltage regulator. The at least one component is switched into use in the linear voltage regulator in response to the linear voltage regulator being operated in an active mode where switchable bias currents of the linear voltage regulator are higher when the linear voltage regulator is operated a low power/sleep mode.

For example, with reference to FIGS. 4A and 4B and to high speed linear voltage regulator 300, in an embodiment where first switchable bias current source Ibias_active/Ibias_sleep is in operating in the Ibias_active setting and second switchable bias current source Ibias_sf_active/Ibias_sf_sleep in the Ibias_sf_active setting, this comprises closing switch SW1 to electrically couple R1 and C1 with the output, Out, of first stage 310. When switch SW1 is closed, R1 and C1 are coupled such that: a first side of R1 is coupled with the output, Out, of first stage 310; the second side of R1 is coupled with a first side of C1; and the second side of C1 is coupled with ground. At the same time, switch SW2 is opened or remains open so that resistor Rlow is not electrically coupled with the output, Out, of first stage 310. By switching in R1 and C1, a left-hand-side zero is created for the linear voltage regulator. This is illustrated by zero 525 in Bode plot 520 of FIG. 5.

In one embodiment, operation of switch SW1 and switch SW2 is under the control of processing system 110 (see e.g., FIG. 1) or other processing system or control logic coupled with high speed linear voltage regulator 300.

The examples set forth herein were presented in order to best explain, to describe particular applications, and to thereby enable those skilled in the art to make and use embodiments of the described examples. However, those skilled in the art will recognize that the foregoing description and examples have been presented for the purposes of illustration and example only. The description as set forth is not intended to be exhaustive or to limit the embodiments to the precise form disclosed.

What is claimed is:

1. A linear voltage regulator comprising:

a first stage configured to output an output signal, wherein said first stage is configured with a first switchable bias current, and wherein said first stage is configured to receive a feedback signal;

a second stage configured to provide a regulated voltage output;

a decoupling capacitor coupled to said regulated voltage output of said second stage;

a feedback circuit coupled with said second stage and configured to generate said feedback signal; and a frequency compensation circuit configured with a second switchable bias current, said frequency compensation circuit configured to:

push away an existing pole to a higher frequency when said first and second switchable bias currents are operated in a sleep mode; and create a left-hand-side zero when said first and second switchable bias currents are operated in an active mode, wherein said active mode comprises said first and second switchable bias currents supplying greater currents than are provided in said sleep mode.

2. The linear voltage regulator of claim 1, wherein said higher frequency is at least a decade away from a unity gain bandwidth frequency of said linear voltage regulator.

3. The linear voltage regulator of claim 1, wherein said first stage, said second stage, and said frequency compensation circuit are disposed on an integrated circuit and said decoupling capacitor is disposed external to said integrated circuit.

4. The linear voltage regulator of claim 1, wherein said frequency compensation circuit further comprises:

a buffer.

5. The linear voltage regulator of claim 1, wherein said frequency compensation circuit further comprises:

an active mode compensation portion which is selectively coupled to said linear voltage regulator to create said left-hand-side zero.

6. The linear voltage regulator of claim 5, wherein said active mode compensation portion comprises a series resistor and capacitor that are configured to be selectively electrically coupled between an output of said first stage and ground.

7. The linear voltage regulator of claim 1, wherein said frequency compensation circuit further comprises:

a sleep mode compensation portion which is selectively coupled to said linear voltage regulator to push away said existing pole of said linear voltage regulator to said higher frequency when said first and second switchable bias currents are operated in said sleep mode.

8. The linear voltage regulator of claim 7, wherein said sleep mode compensation portion comprises a single resistor that is configured to be selectively electrically coupled between an output of said first stage and ground.

9. An integrated circuit comprising:

a first stage of a linear voltage regulator, said first stage configured to output an output signal, wherein said first stage is configured with a first switchable bias current, and wherein said first stage is configured to receive a feedback signal;

a second stage of a linear voltage regulator, said second stage configured to provide a regulated voltage output;

a feedback circuit coupled with said second stage and configured to generate said feedback signal; and a frequency compensation circuit configured with a second switchable bias current, said frequency compensation circuit configured to:

push away an existing pole of said linear voltage regulator to a higher frequency when said first and second switchable bias currents are operated in a sleep mode; and create a left-hand-side zero for said linear voltage regulator when said first and second switchable bias currents are operated in an active mode, wherein said active mode comprises said first and second switchable bias currents supplying greater currents than are provided in said sleep mode.

10. The integrated circuit of claim 9, further comprising:

a decoupling capacitor located on said integrated circuit and connected to said regulated output voltage.

11. The integrated circuit of claim 9, wherein said frequency compensation circuit further comprises:

a buffer comprising a source follower transistor electrically coupled to said output signal.

12. The integrated circuit of claim 9, wherein said frequency compensation circuit further comprises:

an active mode compensation portion which is selectively coupled to said linear voltage regulator to create said left-hand-side zero, said active mode compensation portion comprising a series resistor and capacitor that are configured to be selectively electrically coupled between an output of said first stage and ground.

13. The integrated circuit of claim 9, wherein said frequency compensation circuit further comprises:

a sleep mode compensation portion which is selectively coupled to said linear voltage regulator to push away said existing pole of said linear voltage regulator to said higher frequency when said first and second switchable bias currents are operated in said sleep mode, said sleep mode compensation portion comprising a single resistor that is configured to be selectively electrically coupled between an output of said first stage and ground.

14. The integrated circuit of claim 9, wherein said first stage is configured to receive a bandgap voltage as a reference voltage.

15. The integrated circuit of claim 9, wherein said higher frequency is at least a decade away from a unity gain bandwidth frequency of said linear voltage regulator.

16. A method of linear voltage regulation, said method comprising:

in response to operating a linear voltage regulator in a sleep mode where switchable bias currents of said linear voltage regulator are lower than in an active mode:

switching in at least one circuit component to push away an existing pole of said linear voltage regulator to a higher frequency; and in response to operating said linear voltage regulator in an active mode where switchable bias currents of said linear voltage regulator are higher than in said sleep mode:

switching in at least one circuit component to create a left-hand-side zero for said linear voltage regulator.

17. The method as recited in claim 16, wherein said switching in at least one circuit component to create a left-hand-side zero for said linear voltage regulator comprises:

decoupling a first resistor and capacitor from an output of a first stage of said linear voltage regulator; and electrically coupling a second resistor between ground and said output of the first stage.

18. The method as recited in claim 16, wherein said switching in at least one circuit component to push away an existing pole of said linear voltage regulator to a higher frequency comprises:

switching in at least one circuit component to push said existing pole to a higher frequency that is at least a decade away from a unity gain bandwidth frequency of said linear voltage regulator, wherein absent switching in said at least one circuit component said existing pole is within a decade of said unity gain bandwidth frequency.

19. The method as recited in claim 16, wherein said switching in at least one circuit component to push away an existing pole of said linear voltage regulator to a higher frequency comprises:

electrically coupling a first resistor and capacitor in series with one another between ground and an output of a first stage of said linear voltage regulator; and decoupling a second resistor from said output.

* * * * *